US007950400B2

(12) United States Patent
Rabiei et al.

(10) Patent No.: US 7,950,400 B2
(45) Date of Patent: May 31, 2011

(54) TOBACCO CUT FILLER INCLUDING METAL OXIDE SUPPORTED PARTICLES

(75) Inventors: Shahryar Rabiei, Richmond, VA (US); Firooz Rasouli, Midlothian, VA (US); Mohammad R. Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 971 days.

(21) Appl. No.: 10/972,201

(22) Filed: Oct. 25, 2004

(65) Prior Publication Data

US 2005/0126583 A1 Jun. 16, 2005

Related U.S. Application Data

(60) Provisional application No. 60/514,528, filed on Oct. 27, 2003.

(51) Int. Cl.
*A24D 1/00* (2006.01)

(52) U.S. Cl. ..... 131/364; 131/194; 131/352; 131/353; 131/207; 423/335

(58) Field of Classification Search ..... None
See application file for complete search history.

(56) References Cited

U.S. PATENT DOCUMENTS

| | | | |
|---|---|---|---|
| 3,338,246 | A | 8/1967 | Mays |
| 3,720,214 | A | 3/1973 | Norman et al. |
| 3,807,416 | A | 4/1974 | Hedge et al. |
| 3,931,824 | A | 1/1976 | Miano et al. |
| 4,055,191 | A | 10/1977 | Norman et al. |
| 4,108,151 | A | 8/1978 | Martin et al. |
| 4,109,663 | A | 8/1978 | Maeda et al. |
| 4,119,104 | A | 10/1978 | Roth |
| 4,182,348 | A | 1/1980 | Seehofer et al. |
| 4,195,645 | A | 4/1980 | Bradley, Jr. et al. |
| 4,197,861 | A | 4/1980 | Keith |
| 4,248,251 | A | 2/1981 | Bryant, Jr. et al. |
| 4,450,245 | A | 5/1984 | Adair et al. |
| 4,450,847 | A | 5/1984 | Owens |
| 4,453,553 | A | 6/1984 | Cohn |
| 4,489,739 | A | 12/1984 | Mattina, Jr. et al. |
| 4,524,051 | A | 6/1985 | Wright et al. |

(Continued)

FOREIGN PATENT DOCUMENTS

| | | |
|---|---|---|
| WO | WO 87/06104 | 10/1987 |

(Continued)

OTHER PUBLICATIONS

International Search Report and Written Opinion of the International Searching Authority for PCT/IB2004/003669 dated Jun. 3, 2005.

*Primary Examiner* — Richard Crispino
*Assistant Examiner* — Phu H Nguyen
(74) *Attorney, Agent, or Firm* — Buchanan Ingersoll & Rooney PC

(57) ABSTRACT

A smoking article composition and a method of making a smoking article composition and an additive, wherein the additive comprises particles anchored to the cut filler by a metal oxide support. The additive can be formed by combining particles and a metal oxide precursor solution with the smoking article composition. The smoking article composition can comprise tobacco cut filler, cigarette paper and/or cigarette filter material.

18 Claims, 2 Drawing Sheets

U.S. PATENT DOCUMENTS 4,744,374 A 5/1988 Deffeves et al.
4,888,114 A * 12/1989 Gaddis et al. ..... 210/500.25
5,040,551 A 8/1991 Schlatter
5,101,839 A 4/1992 Jakob et al.
5,105,836 A 4/1992 Gentry et al.
5,129,408 A 7/1992 Jakob et al.
5,211,684 A 5/1993 Shannon et al.
5,284,166 A 2/1994 Cartwright et al.
5,322,075 A 6/1994 Deevi et al.
5,386,838 A 2/1995 Quincy, III
5,534,361 A * 7/1996 Hisano et al. ..... 428/842.3
5,591,368 A 1/1997 Fleischhauer et al.
5,598,868 A 2/1997 Jakob et al.
5,671,758 A 9/1997 Rongved
5,712,219 A 1/1998 Klabunde et al.
5,728,462 A 3/1998 Arino et al.
5,934,289 A 8/1999 Watkins et al.
5,990,373 A 11/1999 Klabunde
6,045,925 A 4/2000 Klabunde et al.
6,053,176 A 4/2000 Adams et al.
6,083,467 A * 7/2000 Takeshima et al. ..... 423/335
6,095,152 A 8/2000 Beven et al.
6,121,191 A 9/2000 Komatsu et al.
6,138,684 A 10/2000 Yamazaki et al.
6,164,287 A 12/2000 White
6,228,904 B1 5/2001 Yadav et al.
6,265,341 B1 7/2001 Komatsu et al.
6,286,516 B1 9/2001 Bowen et al.
6,371,127 B1 4/2002 Snaidr et al.
6,417,423 B1 7/2002 Koper et al.
7,011,096 B2 * 3/2006 Li et al. ..... 131/334
2002/0002979 A1 1/2002 Bowen et al.
2002/0005940 A1 1/2002 Hatada et al.
2002/0062834 A1 5/2002 Snaidr et al.
2003/0000538 A1 1/2003 Bereman
2003/0037792 A1 2/2003 Snaidr et al.
2003/0075193 A1 4/2003 Li et al.

FOREIGN PATENT DOCUMENTS

WO WO 00/40104 7/2000
WO WO 02/24005 3/2002

* cited by examiner

TOBACCO CUT FILLER INCLUDING METAL OXIDE SUPPORTED PARTICLES

This application claims priority under 35 U.S.C. §119 to U.S. Provisional Application No. 60/514,528 entitled TOBACCO CUT FILLER INCLUDING METAL OXIDE SUPPORTED PARTICLES, filed Oct. 27, 2003, the entire content of which is hereby incorporated by reference.

BACKGROUND

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Despite the developments to date, there remains an interest for improved and more efficient methods and compositions for reducing the amount of carbon monoxide and/or nitric oxide in the mainstream smoke of a smoking article during smoking.

SUMMARY

A smoking article composition is provided comprising tobacco cut filler and an additive comprising metal oxide supported particles, wherein the particles are anchored to the cut filler by the metal oxide support. A cigarette can be made comprising the smoking article composition.

Also provided is a method of making a smoking article composition comprising metal oxide supported particles. The method comprises combining tobacco cut filler, particles, and a metal oxide precursor solution having a solvent and a metal oxide precursor, and forming a metal oxide support that anchors the particles to the cut filler.

The particles can comprise carbon, a metal and/or a metal oxide. According to a preferred embodiment the particles comprise carbon nanotubes, activated carbon, a Group IIIB element, a Group IVB element, a Group IVA element, a Group VA element, a Group VIA element, a Group VIIIA element, a Group IB element, zinc, cerium, rhenium and mixtures thereof. According to further preferred embodiments, the particles comprise iron oxide or iron oxyhydroxide.

The particles can be crystalline and/or amorphous and can have an average particles size less than about 10 microns (e.g., less than about 50 nm or less than about 10 nm).

The metal oxide support can comprise an oxide of a Group IIIB element, a Group IVB element, a Group IVA element, a Group VA element, a Group VIA element, a Group VIIIA element, a Group IB element, zinc, cerium, rhenium and mixtures thereof. According to a preferred embodiment, the metal oxide support comprises titanium oxide.

The additive, which consists essentially of metal oxide supported particles, can comprise from about 1 to 50 wt. % particles and from about 50 to 99 wt. % metal oxide support, preferably from about 30 to 40 wt. % particles and from about 60 to 70 wt. % metal oxide support. According to an embodiment, the smoking article composition can comprise from about 5 to 10 wt. % additive. Preferably the smoking article composition comprises particles and a metal oxide support in an amount effective to reduce the ratio of carbon monoxide to total particulate matter in mainstream smoke by at least 25%. According to a preferred embodiment the additive is capable of oxidizing carbon monoxide to carbon dioxide and/or reducing nitric oxide to nitrogen.

The metal oxide precursor solution can comprise a Group IIIB element, a Group IVB element, a Group IVA element, a Group VA element, a Group VIA element, a Group VIIIA element, a Group IB element, zinc, cerium, rhenium and mixtures thereof. According to a preferred method the metal oxide precursor solution comprises titanium.

According to a further preferred method, the metal oxide precursor solution comprises a solvent and a metal oxide precursor selected from the group consisting of alkoxides, β-diketonates, dionates, oxalates and hydroxides. The metal oxide precursor preferably comprises titanium isopropoxide.

The metal oxide precursor can form a metal oxide support upon combining the metal oxide precursor with the smoking article composition. Preferably, the metal oxide precursor undergoes hydrolysis and condensation reactions to form the metal oxide support upon combining the metal oxide precursor with the smoking article composition. In a preferred method, the smoking article composition includes sufficient moisture to promote the hydrolysis reaction.

Metal oxide supported particles can be combined with a smoking article composition such as tobacco cut filler at a temperature of less than about 100° C., more preferably at about room temperature. The step of combining the particles, the metal oxide precursor solution and the smoking article composition can comprise spraying and/or mixing. The particles, metal oxide precursor solution and smoking article composition can be combined simultaneously or sequentially.

A still further embodiment relates to a method of making a cigarette comprising the steps of (i) supplying the additive-containing tobacco cut filler to a cigarette making machine to form a tobacco column; and (ii) placing cigarette paper around the tobacco column to form a tobacco rod of a cigarette.

DETAILED DESCRIPTION OF PREFERRED EMBODIMENTS

Figure 1:
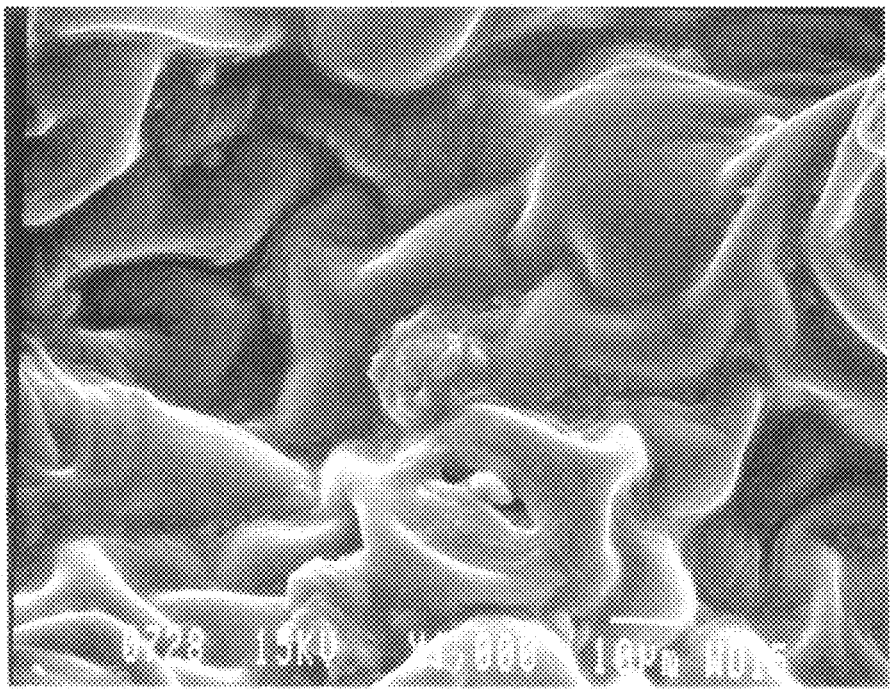
FIG. 1 shows an SEM image of tobacco cut filler prior to forming a metal oxide supported particles on a surface of the tobacco cut filler.

A smoking article composition is provided comprising tobacco cut filler and an additive, wherein the additive comprises particles anchored to the cut filler by a metal oxide support. Also provided is a method of making a smoking article composition comprising an additive. The method comprises combining particles, a metal oxide precursor solution and tobacco cut filler in order to anchor the particles to the tobacco cut filler via the metal oxide support.

The additive, which may be capable of oxidizing carbon monoxide to carbon dioxide and/or reducing nitric oxide to nitrogen, can reduce the amount of carbon monoxide and/or nitric oxide in mainstream smoke during smoking, thereby also reducing the amount of carbon monoxide or nitric oxide reaching the smoker and/or given off as second-hand smoke.

The additive can comprise carbon, metal and/or metal oxide particles dispersed within and/or on a metal oxide support. The particles can comprise catalytic particles and/or adsorbent particles. Preferably the particles are physically entrapped by the metal oxide support. Preferably the metal oxide support is thermally stable and catalytically active.

A general formula, by weight, for the additive is 1-50% carbon, metal and/or metal oxide particles; preferably between about 30 to 40%, and 50-99% metal oxide support; preferably between about 60 to 70%.

The additive preferably comprises a metal oxide support that can be formed via hydrolysis and condensation of a metal oxide precursor. A metal oxide precursor solution can be combined with a smoking article composition (e.g., tobacco cut filler) wherein the metal oxide precursor can react with water (e.g., moisture) present in the smoking article composition to undergo hydrolysis and condensation reactions and form the metal oxide support. The metal oxide support can penetrate into and/or be formed around fibers of the tobacco cut filler to thereby anchor the particles to the cut filler.

According to a preferred embodiment, the additive can be formed by first combining particles and a metal oxide precursor solution to form a mixture and then combining the mixture with a smoking article composition (e.g., the particles are combined with the metal oxide precursor solution prior to combining the metal oxide precursor solution with the smoking article composition). According to yet a further embodiment, the additive can be formed by simultaneously combining particles, a metal oxide precursor solution and a smoking article composition. By combining particles, a metal oxide precursor solution and a smoking article composition sequentially or simultaneously, a smoking article composition comprising an additive capable of reducing the amount of carbon monoxide and/or nitric oxide in mainstream smoke during smoking can be formed. The additive comprises particles anchored to the cut filler by a metal oxide support.

According to an embodiment, the particles can comprise commercially available metal or metal oxide particles (e.g., nanoscale particles and/or micron-sized particles) that comprise Group IIIB elements (B, Al); Group IVB elements (C, Si, Ge, Sn); Group IVA elements (Ti, Zr, Hf); Group VA elements (V, Nb, Ta); Group VIA elements (Cr, Mo, W), Group VIIIA elements (Fe, Co, Ni, Ru, Rh, Pd, Os, Ir, Pt); Group IB elements (Cu, Ag, Au), Zn, Ce and Re and/or oxides thereof. For example, preferred metal particles include Fe, Ni, Pt, Cu and Au. Preferred oxide particles include titania, iron oxide, copper oxide, silver oxide and cerium oxide. The particles can also comprise carbon particles such as, for example, carbon nanotubes, activated carbon and PICA carbon.

Nanoscale particles are a class of materials whose distinguishing feature is that their average grain or other structural domain size is below 500 nm. The nanoscale particles can have an average particle size less than about 100 nm, preferably less than about 50 nm, more preferably less than about 10 nm. At this small scale, a variety of confinement effects can significantly change the properties of the material that, in turn, can lead to commercially useful characteristics. For example, nanoscale iron oxide particles can exhibit a much higher percentage of conversion of carbon monoxide to carbon dioxide than larger, micron-sized iron oxide particles.

The additive can preferably comprise nanoscale iron oxide particles. For instance, MACH I, Inc., King of Prussia, Pa. sells nanoscale iron oxide particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities, and is suitable for use in food, drugs, and cosmetics. The NANOCAT® Magnetic Iron Oxide is a free flowing powder with a particle size of about 25 nm and a surface area of about 40 $m^2/g$.

A variety of compounds can be used as the metal oxide precursor for the metal oxide support. The metal oxide precursor can be a soluble salt, such as a nitrate, chloride or sulfate. The metal oxide precursor solution preferably comprises a dispersion, sol or colloidal mixture in a solvent. A dispersion, sol or colloidal mixture can be any suitable concentration such as, for example, 10 to 60 wt. %, e.g., a 15 wt. % dispersion or a 40 wt. % dispersion.

As described above, the additive can comprise particles that are commercially available (e.g., commercially available nanoscale particles). The metal oxide support can be formed in situ upon being combined with a smoking article composition. Formation of the metal oxide support can start with a metal oxide precursor containing the desired metallic element dissolved in a solvent. For example, the process can involve a single metal oxide precursor bearing one or more metallic atoms or the process can involve multiple single metallic precursors that are combined in solution to form a solution mixture. Upon formation of the metal oxide support, the metal oxide preferably penetrates into and/or forms around fibers of the cut filler. The metal oxide support can be in the form of individual and agglomerated particles having particle sizes of less than or equal to 1 μm and particles larger than 1 μm (e.g., 2 to 10 μm in size).

The metal oxide precursors preferably are high purity, non-toxic, and easy to handle and store (with long shelf lives). Desirable physical properties include solubility in solvent systems, compatibility with other precursors for multi-component synthesis, and volatility for low temperature processing.

The metal oxide support can be obtained from a single metal oxide precursor, mixtures of metal oxide precursors or from single-source metal oxide precursor in which two or more metallic elements are chemically associated. The desired stoichiometry of the resultant particles can match the stoichiometry of the metal oxide precursor solution.

The metal oxide precursors are preferably metal organic compounds, which have a central main group, transition, lanthanide, or actinide metal atom or atoms bonded to a bridging atom (e.g., N, O, P or S) that is in turn bonded to an organic radical. Examples of the main group metal atom include, but are not limited to Group IIIB elements (B, Al); Group IVB elements (C, Si, Ge, Sn); Group IVA elements (Ti, Zr, Hf); Group VA elements (V, Nb, Ta); Group VIA elements (Cr, Mo, W), Group VIIIA elements (Fe, Co, Ni, Ru, Rh, Pd, Os, Ir, Pt); Group IB elements (Cu, Ag, Au); Zn; Ce and/or Re. Such compounds may include metal alkoxides, β-diketonates, carboxylates, oxalates, citrates, metal hydrides, thiolates, amides, nitrates, carbonates, cyanates, sulfates, bromides, chlorides, and hydrates thereof. The metal oxide precursor can also be a so-called organometallic compound, wherein a central metal atom is bonded to one or more carbon atoms of an organic group. Exemplary metal oxide support materials include alumina, silica, magnesia, titania, vanadia, yttria, zirconia, ceria, oxides of iron and combinations thereof, including silica-alumina-titania, silica-magnesia, silica-yttria and silica-alumina-zirconia. Aspects of processing with these metal oxide precursors are discussed below.

Precursors for the formation of a metal oxide support are advantageously molecules having pre-existing metal-oxygen bonds such as metal alkoxides $M(OR)_n$ or oxoalkoxides $MO(OR)_n$ (R=saturated or unsaturated organic group, alkyl or aryl), β-diketonates $M(\beta\text{-diketonate})_n$ (β-diketonate=RCOCHCOR') and metal carboxylates $M(O_2CR)_n$. Metal alkoxides have both good solubility and volatility. Generally, however, these compounds are highly hydroscopic and require storage under inert atmosphere. In contrast to metal alkoxides (e.g., titanium alkoxide), which are liquids, the alkoxides based on most metals are solids. On the other hand, the high reactivity of the metal-alkoxide bond can make these metal oxide precursor materials useful as starting compounds for a variety of heteroleptic species (i.e., species with different types of ligands) such as $M(OR)_{n-x}Z_x$ (Z=β-diketonate or $O_2CR$).

Metal alkoxides $M(OR)_n$ react easily with the protons of a large variety of molecules. This allows easy chemical modification and thus control of stoichiometry by using, for example, organic hydroxy compounds such as alcohols, silanols ($R_3SiOH$), glycols $OH(CH_2)_nOH$, carboxylic and hydroxycarboxylic acids, hydroxyl surfactants, etc.

Fluorinated alkoxides $M(OR_F)_n$ ($R_F$=$(CF_3)_2$, $C_6F_5$, . . . ) are readily soluble in organic solvents and less susceptible to hydrolysis than classical alkoxides. These materials can be used as precursors for fluorides, oxides or fluoride-doped oxides such as F-doped tin oxide, which can be used as the metal oxide support.

Modification of metal alkoxides reduces the number of M-OR bonds available for hydrolysis and thus hydrolytic susceptibility. Thus, it is possible to control the solution chemistry in situ by using, for example, β-diketonates (e.g. acetylacetone) or carboxylic acids (e.g. acetic acid) as modifiers for, or in lieu of, the alkoxide.

Metal β-diketonates $[M(RCOCHCOR')_n]_m$ are attractive metal oxide precursors because of their volatility and high solubility. Their volatility is governed largely by the bulk of the R and R' groups as well as the nature of the metal, which will determine the degree of association, m, represented in the formula above. Acetylacetonates (R=R'=$CH_3$) are advantageous because they can provide good yields.

Metal β-diketonates are prone to a chelating behavior that can lead to a decrease in the nuclearity of these precursors. These ligands can act as surface capping reagents and polymerization inhibitors.

Metal carboxylates such as acetates ($M(O_2CMe)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents. A large number of carboxylate derivatives are available for aluminum. For example, formate $Al(O_2CH)_3(H_2O)$ and carboxylate-alumoxanes $[AlO_x(OH)_y(O_2CR)_z]_m$ can be prepared from the inexpensive minerals gibsite or boehmite.

The solvent(s) used are selected based on a number of criteria including high solubility for the metal oxide precursors; chemical inertness to the metal oxide precursors; rheological compatibility with the smoking article composition (e.g., the desired wettability and/or compatibility with other rheology adjusters); boiling point; vapor pressure and rate of vaporization; and economic factors (e.g. cost, recoverability, toxicity, etc.).

Solvents that may be used include pentanes, hexanes, cyclohexanes, xylenes, ethyl acetates, toluene, benzenes, tetrahydrofuran, acetone, carbon disulfide, dichlorobenzenes, nitrobenzenes, pyridine, chloroform, mineral spirits and alcohols such as methyl alcohol, ethyl alcohol, propyl alcohol, isopropyl alcohol and butyl alcohol, and mixtures thereof.

By combining a metal oxide precursor solution with a smoking article composition, the metal oxide precursor can form a metal oxide support via hydrolysis and condensation reactions when the metal oxide precursor interacts with moisture in the smoking article composition. After coating the metal oxide precursor solution with the smoking article composition, the coated smoking article composition can be maintained at a temperature of between from about 0 to 100° C., preferably about 40 to 80° C., until the reaction between the metal oxide precursor and water in the smoking article composition is complete. Thus, an additive comprising particles supported on the metal oxide support and incorporated onto a surface of a smoking article composition can be prepared via the condensation of the particle-containing metal oxide precursor. According to a preferred embodiment an additive comprising particles supported on the metal oxide support and incorporated onto a surface of a smoking article composition can be prepared by combining particles with a mixture of a metal oxide precursor solution and smoking article composition before and/or during condensation of the metal oxide precursor.

By way of example, the metal oxide support can be prepared from an titanium oxide precursor solution. The titanium oxide precursor solution can comprise a titanium oxide precursor such as titanium isopropoxide and a solvent such as isopropyl alcohol that are combined at a pH of at least about 7, preferably from about 8 to 11. As described below, the precursor for the metal oxide support is preferably a liquid or dispersed solid, e.g., a sol or colloidal suspension. A metal oxide support can be prepared via the condensation of a sol, colloidal suspension and/or dispersion.

The metal oxide support is preferably an adhesion layer that is adhered to the smoking article composition and to the particles. Thus, the metal oxide support can comprise an adhesion layer that binds the particles to the smoking article composition. Advantageously, the metal oxide support can reduce agglomeration of the particles by inhibiting diffusion and interaction of the particles. By reducing agglomeration of the particles the loss of active surface area can be minimized. Furthermore, the metal oxide support can reduce diffusion of the particles into the smoking article composition by functioning as a barrier layer.

After the metal oxide precursor has been combined with the smoking article composition, the solvent and liquids that can be formed during hydrolysis and condensation of the metal oxide precursor may be substantially removed by vacuum, such as by reducing the pressure of the atmosphere surrounding the smoking article composition, or by convection such as by increasing the temperature of the smoking article composition to higher than the boiling point of the liquid. For example, by combining titanium isopropoxide with water, the titanium isopropoxide can undergo hydrolysis and condensation reactions to form titanium oxide and propyl alcohol according to the reaction:

$$Ti(C_3H_7O)_4+2H_2O \rightarrow TiO_2+4C_3H_8O$$

The metal oxide precursor that forms the metal oxide support can be combined in any suitable ratio with particles to give a desired loading of particles in the support. Iron oxide particles, such as nanoscale iron oxide particles, and titanium isopropoxide can be combined, for example, to produce from 1% to 50% wt. %, e.g. 15 wt. % or 25 wt. %, iron oxide particles dispersed on a titanium oxide support.

Regardless of the method of preparing an additive on a surface of a smoking article composition, the additive may contain amorphous and/or crystalline particles dispersed on an amorphous metal oxide support.

Nanoscale particles of iron oxide are a preferred constituent in the additive because iron oxide can have a dual function as a CO catalyst in the presence of oxygen and as a CO oxidant for the direct oxidation of CO in the absence of oxygen. A catalyst that can also be used as an oxidant is especially useful for certain applications, such as within a burning cigarette where the partial pressure of oxygen can be very low.

"Smoking" of a cigarette refers to heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075.

The term "mainstream" smoke refers to the mixture of gases passing down the tobacco rod and issuing through the filter end, i.e. the amount of smoke issuing or drawn from the mouth end of a cigarette during smoking of the cigarette.

In addition to the constituents in the tobacco, the temperature and the oxygen concentration are factors affecting the formation and reaction of carbon monoxide, carbon dioxide and nitric oxide. The majority of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the additive can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor and various organic compounds, the concentration of oxygen is low in the combustion zone. The low oxygen concentrations coupled with the high temperature leads to the reduction of carbon dioxide to carbon monoxide by the carbonized tobacco. In this region, an additive can convert carbon monoxide to carbon dioxide via both catalysis and oxidation mechanism. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e., the thermal degradation) of the tobacco that produces carbon monoxide, carbon dioxide, nitric oxide, smoke components and charcoal using the heat generated in the combustion zone. There is some oxygen present in this region, and thus the additive may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The additive will preferably be distributed throughout the tobacco rod portion of a cigarette. By providing the additive throughout the tobacco rod, it is possible to reduce the amount of carbon monoxide and/or nitric oxide drawn through the cigarette, and particularly at both the combustion region and in the pyrolysis zone. The additive may be provided along the length of a tobacco rod by forming the additive on the tobacco cut filler used to form the cigarette.

The smoking article composition may be coated with a metal oxide precursor solution by immersing the smoking article composition in the solution and/or by spraying the solution onto the smoking article composition.

The amount of the additive incorporated onto a surface of a smoking article composition can be selected such that the amount of carbon monoxide and/or nitric oxide in mainstream smoke is reduced during smoking of a cigarette. In an embodiment, the amount of the additive will be a catalytically effective amount, e.g., an amount sufficient to oxidize and/or catalyze at least 10%, preferably at least 25% of the carbon monoxide in mainstream smoke, more preferably at least 50%. For example, preferably the additive comprises iron oxide particles and a titanium oxide support in an amount effective to reduce the ratio of carbon monoxide to total particulate matter in mainstream smoke by at least 25%.

In a test to observe the effect of the additive on reduction of constituents of tobacco smoke, additive modified tobacco cut filler was prepared and about 0.75 grams of additive modified cut filler was combusted in a flow tube connected to a gas analyzing device. The tobacco cut filler included 6.6 wt. % $Fe_2O_3$ nanoparticles (NANOCAT) and 8.6 wt. % $TiO_2$ and the additive was incorporated into the tobacco cut filler by mixing NANOCAT in a solution of titanium isopropoxide and isopropyl alcohol with the tobacco cut filler followed by drying the tobacco. The following results were observed when the additive containing tobacco was combusted compared to tobacco cut filler free of the catalyst:

TABLE I

| | Puff | TPM mg | RTD | CO mg | NO μg | $CO_2$ mg |
|---|---|---|---|---|---|---|
| Sample Without Additive Average | 8.6 | 19.5 | 92.5 | 15.6 | 264 | 41.3 |
| STD | 0.4 | 0.1 | 3.1 | 1.2 | 19.2 | 2.3 |
| Sample with Additive Average | 6.5 | 7.3 | 99.3 | 12.3 | 177 | 32.2 |
| STD | 0.7 | 0.8 | 8.5 | 1.8 | 29.7 | 2.8 |
| Change | | | | −21% | −33% | −22% |

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

Techniques for cigarette manufacture are known in the art. Any conventional or modified cigarette making technique may be used to incorporate the additive. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. The circumference is from about 15 mm to about 30 mm in circumference, and preferably around 25 mm. The tobacco packing density is typically between the range of about 100 mg/cm$^3$ to about 300 mg/cm$^3$, preferably from about 150 mg/cm$^3$ to about 275 mg/cm$^3$.

Examples of preferred embodiments are described below.

EXAMPLE 1

A nanoscale iron oxide-titanium oxide additive was prepared as follows: Titanium isopropoxide was dissolved in isopropyl alcohol to give a 0.2 M metal oxide precursor solution (titania sol). The metal oxide precursor solution was spray coated in a closed dry vessel at room temperature onto tobacco cut filler having about 10 wt. % moisture. Following about 2 min. reaction time, a partially condensed titanium oxide support was obtained coating the surface of the tobacco cut filler. Nanoscale particles of iron oxide were sprayed onto the titanium oxide support-coated tobacco cut filler to give about 7 wt. % iron oxide and about 9% titanium oxide on the tobacco cut filler.

EXAMPLE 2

Figure 2:
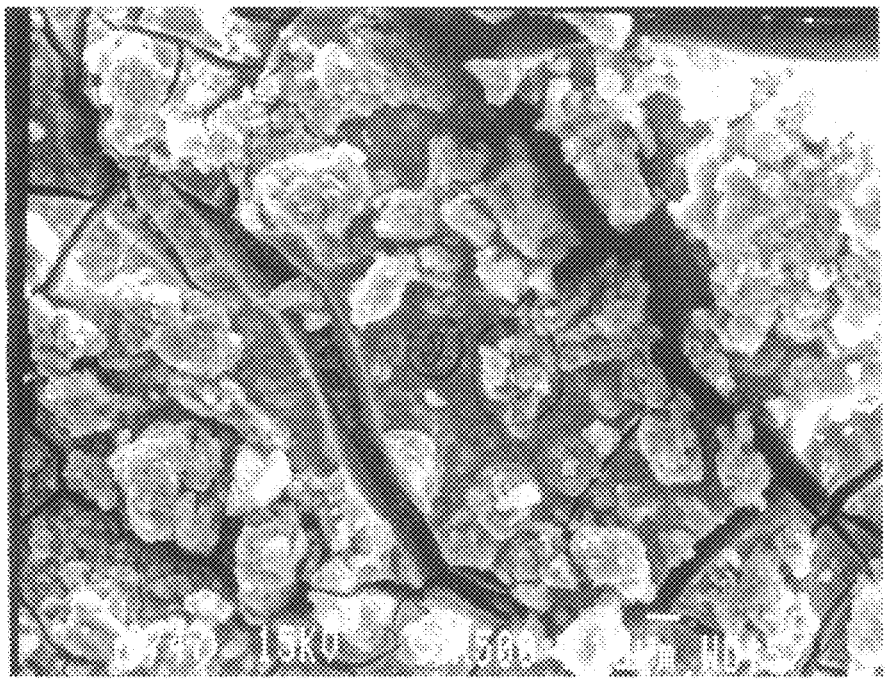
FIG. 2 shows an SEM image of tobacco cut filler after being sprayed with a mixture comprising titanium isopropoxide and nanoscale particles of iron oxide.
Figure 3:
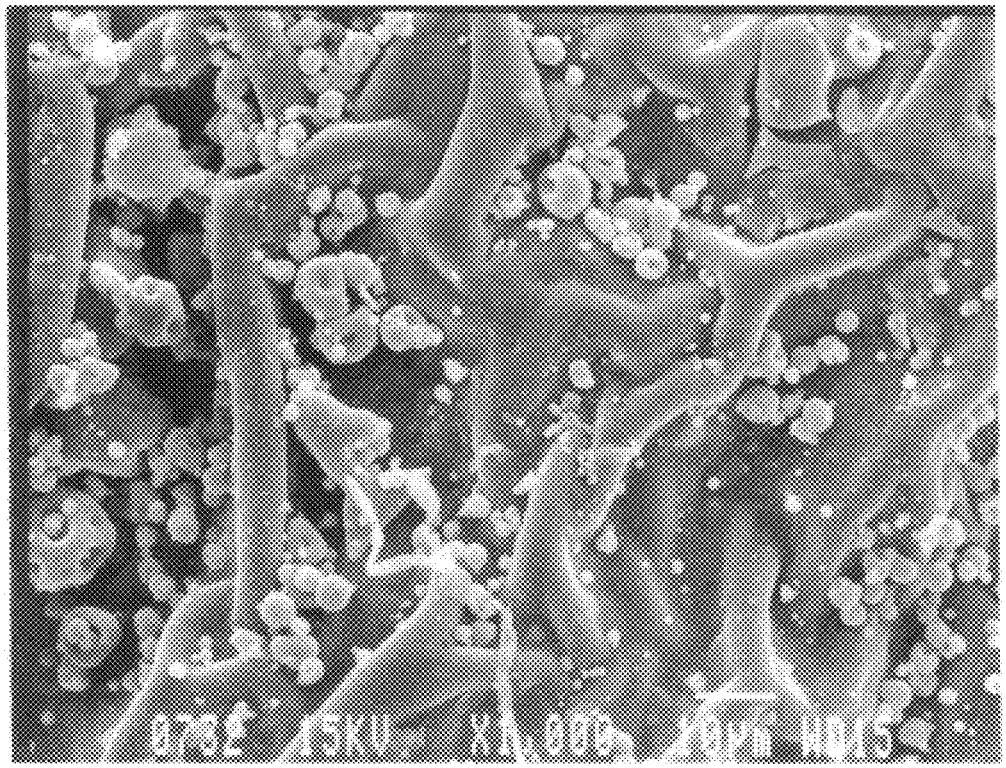
FIG. 3 shows an SEM image of a nanoscale iron oxide/titanium oxide additive on the surface of tobacco cut filler.

A titania sol was prepared as described in Example 1. Nanoscale iron oxide particles were added to the sol prior to condensation to give a slurry comprising about 5% by weight nanoscale iron oxide particles. The slurry was spray coated onto tobacco cut filler at room temperature to form a nanoscale iron oxide/titanium oxide catalyst comprising about 7 wt. % iron oxide and about 9 wt. % titanium oxide on tobacco cut filler. FIG. 1 shows an SEM image of a surface of the tobacco cut filler of Example 2 prior to combining the tobacco cut filler with the slurry. FIG. 2 shows an SEM image of a surface of the tobacco cut filler after combining the tobacco cut filler with the slurry. FIG. 3 shows a nanoscale iron oxide/titanium oxide additive adhered to the surface of the tobacco.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A smoking article composition comprising tobacco cut filler and an additive, wherein the additive comprises particles anchored to the cut filler by a metal oxide support, wherein the metal oxide support includes discrete agglomerated non-spherical metal oxide particles, wherein the additive is capable of oxidizing carbon monoxide to carbon dioxide and/or reducing nitric oxide to nitrogen, and wherein the particles are physically entrapped by the metal oxide support and the metal oxide support penetrates into and/or surrounds fibers of the cut filler.

2. The smoking article composition of claim 1, wherein the metal oxide support has various particle sizes ranging from sub-micron to 1 μ m and larger.

3. The smoking article composition of claim 1, wherein the particles comprise a metal and/or a metal oxide.

4. The smoking article composition of claim 1, wherein the particles comprise carbon nanotubes, activated carbon, a Group IIIB element, a Group IVB element, a Group IVA element, a Group VA element, a Group VIA element, a Group VIIIA element, a Group IB element, zinc, cerium, rhenium and mixtures thereof.

5. The smoking article composition of claim 1, wherein the particles comprise iron oxide.

6. The smoking article composition of claim 1, wherein the particles comprise iron oxyhydroxide.

7. The smoking article composition of claim 1, wherein the particles have an average particle size less than about 10 microns.

8. The smoking article composition of claim 1, wherein the particles have an average particle size less than about 50 nm.

9. The smoking article composition of claim 1, wherein the particles have an average particle size less than about 10 nm.

10. The smoking article composition of claim 1, wherein the particles are crystalline.

11. The smoking article composition of claim 1, wherein the particles are amorphous.

12. The smoking article composition of claim 1, wherein the metal oxide support comprises titanium oxide.

13. The smoking article composition of claim 1, wherein the metal oxide support comprises an oxide of a Group IIIB element, a Group IVB element, a Group IVA element, a Group VA element, a Group VIA element, a Group VIIIA element, a Group IB element, zinc, cerium, rhenium and mixtures thereof.

14. The smoking article composition of claim 1, wherein the additive comprises from about 1 to 50 wt. % particles and from about 50 to 99 wt. % metal oxide support.

15. The smoking article composition of claim 1, wherein the additive comprises from about 30 to 40 wt. % particles and from about 60 to 70 wt. % metal oxide support.

16. The smoking article composition of claim 1, wherein the smoking article composition comprises from about 1 to 10 wt. % additive.

17. The smoking article composition of claim 1, wherein the additive comprises particles and a metal oxide support in an amount effective to reduce the ratio of carbon monoxide to total particulate matter in mainstream smoke by at least 10% or at least 25%.

18. A cigarette comprising the smoking article composition of claim 1.

* * * * *